US008333280B2

(12) United States Patent
Le

(10) Patent No.: US 8,333,280 B2
(45) Date of Patent: Dec. 18, 2012

(54) CHILD RESISTANT PACKAGE

(75) Inventor: Thanhhung N. Le, Holly Springs, NC (US)

(73) Assignee: MeadWestvaco Corporation, Richmond, VA (US)

( * ) Notice: Subject to any disclaimer, the term of this patent is extended or adjusted under 35 U.S.C. 154(b) by 511 days.

(21) Appl. No.: 11/994,811

(22) PCT Filed: Feb. 23, 2007

(86) PCT No.: PCT/US2007/062693

§ 371 (c)(1),
(2), (4) Date: Jan. 11, 2010

(87) PCT Pub. No.: WO2007/101098

PCT Pub. Date: Sep. 7, 2007

(65) Prior Publication Data

US 2010/0126886 A1 May 27, 2010

Related U.S. Application Data

(60) Provisional application No. 60/776,021, filed on Feb. 23, 2006.

(51) Int. Cl.
*B65D 85/42* (2006.01)

(52) U.S. Cl. ..... 206/531; 206/1.5; 206/539

(58) Field of Classification Search ..... 206/1.5, 206/459.5, 460, 528, 530, 531, 534, 538, 206/539, 807
See application file for complete search history.

(56) References Cited

U.S. PATENT DOCUMENTS

| | | | | |
|---|---|---|---|---|
| 3,387,699 | A * | 6/1968 | Heller | 206/531 |
| 4,120,400 | A | 10/1978 | Kotyuk | |
| 4,192,422 | A | 3/1980 | Kotyuk | |
| 5,019,125 | A | 5/1991 | Rebne et al. | |
| 5,163,559 | A * | 11/1992 | Bunin | 206/532 |
| 5,275,291 | A | 1/1994 | Sledge | |
| 6,082,544 | A * | 7/2000 | Romick | 206/531 |
| 6,217,966 | B1 * | 4/2001 | Finster et al. | 428/42.1 |
| 6,338,408 | B1 | 1/2002 | Anderson | |
| 6,349,831 | B1 | 2/2002 | Buss | |

(Continued)

FOREIGN PATENT DOCUMENTS

DE 3832049 * 3/1990

(Continued)

*Primary Examiner* — Luan K Bui
(74) *Attorney, Agent, or Firm* — MWV Intellectual Property Group

(57) ABSTRACT

A child-resistant package (100) is formed from a sleeve (14) comprising a top (16) and a base (18), at least one of which is an outer wall of the sleeve (14). A release mechanism (20) for facilitating access to the contents of the package (100) is disposed in the outer wall (16). A decoy cover (60) having at least one outermost panel (62) is disposed in relation to the outer wall (16) to obscure the release mechanism (20). The package (100) may include an insert (12) that is held within the sleeve (14) by a locking mechanism that is disengaged by the release mechanism (20). The decoy cover (60) is attached to the outer wall (16) in a manner that facilitates repeated successive removal and reattachment of the decoy cover (60). The decoy cover (60) may further include one or more additional panels (64) disposed in flat-face condition with the outermost panel (62).

10 Claims, 3 Drawing Sheets

U.S. PATENT DOCUMENTS

| | | | | |
|---|---|---|---|---|
| 6,523,691 | B2 * | 2/2003 | Raj et al. | 206/538 |
| 6,631,805 | B2 * | 10/2003 | Bramen | 206/538 |
| 6,640,693 | B2 | 11/2003 | Brezovnik et al. | |
| 6,695,144 | B2 | 2/2004 | Freeze | |
| 6,752,272 | B2 | 6/2004 | Jones et al. | |
| 7,401,702 | B2 * | 7/2008 | Hession | 206/531 |
| 7,798,329 | B2 | 9/2010 | Gelardi | |
| 7,802,677 | B2 | 9/2010 | Williams | |
| 7,845,496 | B2 | 12/2010 | Hession | |
| 2003/0062287 | A1 | 4/2003 | Gelardi et al. | |
| 2003/0102321 | A1 | 6/2003 | Maietta | |
| 2003/0209460 | A1 | 11/2003 | Bolnick et al. | |
| 2004/0188312 | A1 * | 9/2004 | Stepowany | 206/531 |
| 2005/0183981 | A1 | 8/2005 | Gelardi | |
| 2008/0257773 | A1 | 10/2008 | Gelardi | |

FOREIGN PATENT DOCUMENTS

| | | | |
|---|---|---|---|
| DE | 40 01 645 | A1 | 8/1991 |
| EP | 0547730 | A2 | 6/1993 |
| EP | 1 002 744 | A1 | 5/2000 |
| EP | 1277670 | B1 | 5/2005 |
| GB | 1279941 | A | 6/1972 |
| JP | 2000 062843 | | 2/2000 |
| WO | WO 2004/037657 | A2 | 5/2004 |
| WO | WO 2005/030606 | | 4/2005 |
| WO | WO 2005/068304 | A2 | 7/2005 |
| WO | WO 2007/101098 | A1 | 9/2007 |

* cited by examiner

CHILD RESISTANT PACKAGE

RELATED APPLICATIONS

This application claims priority to U.S. Application No. 60/776,021, filed Feb. 23, 2006, the entirety of which is incorporated herein by reference.

TECHNICAL FIELD

The present invention relates generally to a child-resistant package for storing and dispensing items or products, and more specifically, the present invention is directed to a package including a locking mechanism, a releasing mechanism, and a decoy cover that obscures the releasing mechanism.

BACKGROUND OF THE INVENTION

Most child-resistant packaging relies on locking mechanisms with a release mechanism that requires adult skills, such as cognitive thought, strength, and/or dexterity, to access the contents of the package. However, release mechanisms that require strength may make the package inaccessible by older adults. Additionally, release mechanisms that require cognitive thought or dexterity may be triggered accidentally by a child.

Associated locking and release mechanisms are particularly useful in packages that utilize inserts. For example, many medicines are packaged in blister cards that are inserted in a sleeve and secured in the sleeve by a locking mechanism. Such blister cards have bubbles formed from a plastic sheet wherein the bubbles are sealed by a paper layer or foil. The paper layer or foil is punctured or ruptured as a typical means of releasing one dose from a corresponding bubble. Generally, when the release mechanism for the locking mechanism is triggered, the inserted blister card can be partially or fully removed from the sleeve so that the contents of the package are partially or fully exposed.

There remains in the art a need for packaging that is increasingly child-resistant, especially where the contents can be exposed when the release mechanism of a package is triggered.

SUMMARY OF THE INVENTION

The present invention overcomes the shortcomings of the prior art by providing a decoy cover for a child-resistant package that creates an additional barrier for children to overcome in order to attain access to the contents of the package, while facilitating adult use and maintaining low cost of manufacture. The decoy cover can be applied to packages that include a release mechanism disposed in an outer wall of the package, wherein the release mechanism is used to gain access to the contents of the package.

In one aspect of the invention, a package is formed from a sleeve that has at least one outer wall. A release mechanism for facilitating access to the contents of the package is disposed in the outer wall. A decoy cover having an outermost panel is disposed in relation to the outer wall to obscure the release mechanism.

In a further aspect of the invention, a package is formed from a sleeve that has an outer wall and an insert is held within the package by a locking mechanism. A release mechanism for facilitating at least partial removal of the insert is disposed in the outer wall. A decoy cover is disposed in relation to the outer wall to obscure the release mechanism.

In another aspect of the invention, the decoy cover is attached to the outer wall in a manner that facilitates repeated successive removal and reattachment.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
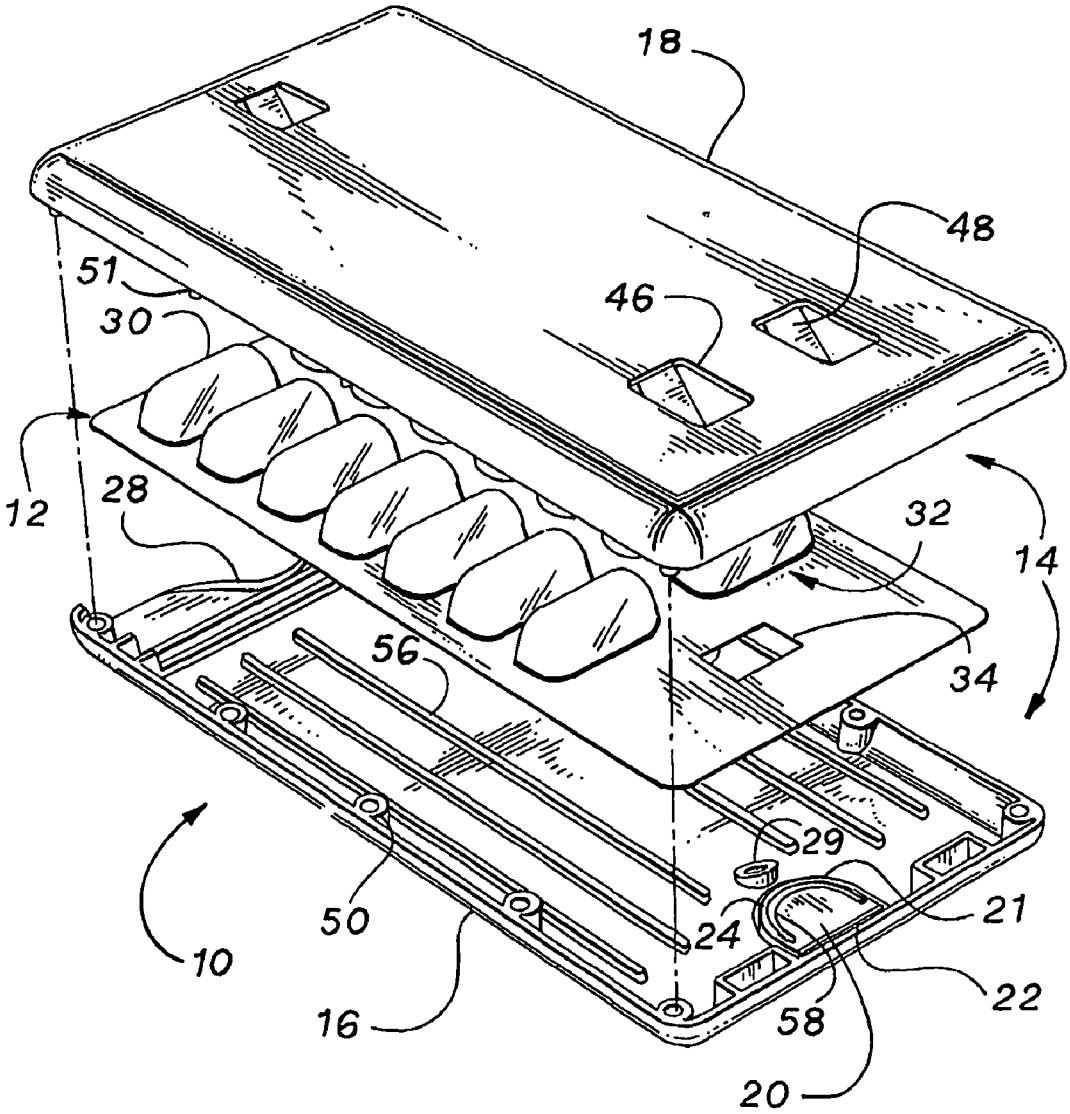
Fig. 1 PRIOR ART
FIG. 1 is an exploded view of a prior art child-resistant package including elements for forming a sleeve and an insect.

As required, detailed embodiments of the present invention are disclosed herein. It must be understood that the disclosed embodiments are merely exemplary of the invention that may be embodied in various and alternative forms, and Combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments of a child-resistant package, according to the present invention. Generally described, the basic package includes a blister card and an outer sleeve. Sometimes, herein for simplicity, the outer sleeve will simply be referred to as a sleeve. The blister card is retained in the outer sleeve by a locking mechanism to form the basic package. The blister card can be released from the outer sleeve by a release mechanism. In accordance with the teachings of the invention, a decoy cover is disposed on an outer wall of the outer sleeve to cover and otherwise obscure the release mechanism, making it more difficult for a child to gain access to the contents of the package. This enhances or increases the child-resistance characteristic of the package.

Figure 2:
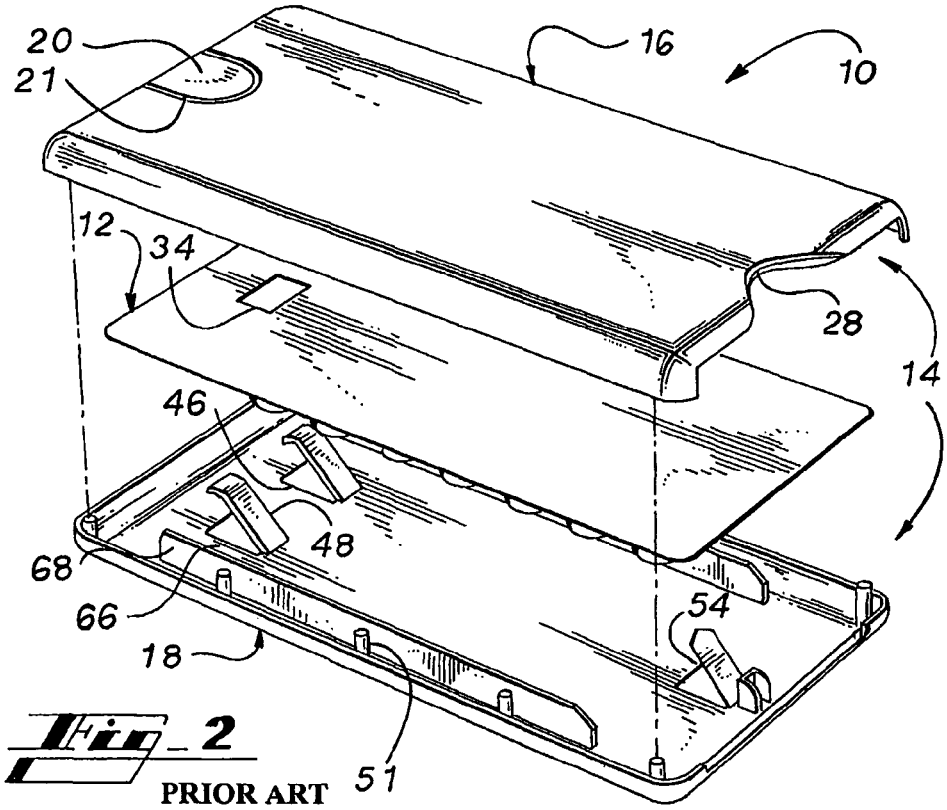
Fig. 2 PRIOR ART
FIG. 2 is an alternative exploded view of the child-resistant package of FIG. 1.

FIGS. 1 and 2 illustrate exemplary embodiments of elements for forming a sleeve 14 together with an insert in the form of a blister card 12 for ultimately forming a child-resistant package 10 in accordance with the teachings of the present invention. The outer sleeve 14 includes a top 16 and a base 18 that form the outer walls of the sleeve 14. In FIG. 2 the orientation of the of the insert 12, top 16 and base 18 are inverted and rotated 180 degrees as compared to FIG. 1 in order to more clearly show all of the features of the elements. The top 16 and the base 18 may be integrally connected and the outer sleeve 14 may be formed in any suitable manner and from any material suitable for forming a container or package in general. For example, the outer sleeve 14 may be molded from plastic or may be formed from a paperboard blank that is folded to erect the outer sleeve, or a combination thereof, and the like.

The blister card 12 has blisters 30 that can contain one or more articles. Here, for purposes of teaching and not limitation, the articles are doses of medication. The blisters 30 are arranged on the blister card 12 in two columns 32 to avoid obstruction by the internal features of the outer sleeve 14 as the blister card 12 slides within the outer sleeve 14. The illustrated blister card 12 further includes an aperture 34 that is designed to receive a detent, as further described below. The blister card 12 is constructed of the same materials with strengths and thicknesses as are conventional in blister cards sold in traditional cardboard sleeves.

The top 16 and the base 18 include elements that are designed to selectively position, retain, and release the blister card 12 or otherwise form a locking mechanism and a release mechanism. The illustrated release mechanism includes a push button 20 that is integrally formed in the outer sleeve 14. The push button 20 in the embodiment illustrated is essentially a spring-loaded member that is deflectable. The push button 20 is defined in the top 16 by a U-shaped channel 21, wherein the channel 21 fully extends through the top 16. The push button 20 can be allowed to deflect by a resilient living hinge section 22 that is disposed at the supported end of the push button 20. A free end 24 is defined as the end of the push button 20 that opposes the supported end of the push button 20.

The illustrated locking mechanism includes a detent 29 that is adjacent to the free end 24 of the push button 20. The detent 29 extends inwardly from the inside surface of the top 16 and the upper surface of the detent 29 slants upwardly. More specifically, the highest portion of the upper surface of the detent 29 is closest to the push button 20. The locking mechanism further includes means for engaging, such as flat springs 48 that extend inwardly from openings 46. The openings 46 are disposed in the base 18. Other means for engaging include ribs, leaf springs, dagger springs, and the like, which exert a compressive force.

Other elements are provided to facilitate partially withdrawing the blister card 12 from the locking sleeve. A cutout 28 is provided in the outer edge of top 16 to expose a portion of the blister card, which can then be gripped. Ribs 56 are optionally included in the inside surface of the top 16. The ribs 56 on the inside of the top 16 facilitate sliding the blister card 12 within the outer sleeve 14. There is also a rib 58 on the inside surface of the push button 20 that facilitates engaging the blister card 12. The base 18 includes a retainer 54 such that the blister card 12, once inserted in the outer sleeve 14, cannot easily be fully removed from the outer sleeve 14. The retainer 54 extends inwardly from an opening in the base 18.

In some embodiments, the top 16 and the base 18 may further include elements that facilitate assembling the outer sleeve 14. For example, as shown, the top 16 includes hollow cylinders 50 and the base 18 includes pins 51. Each cylinder 50 corresponds to a respective pin 51 such that, as each pin 51 is received in a respective cylinder 50, the outer sleeve 14 is formed. A blister card 12 can be inserted into the sleeve 14 or can be placed in the sleeve 14 during assembly of the sleeve 14. A fully-formed sleeve 14 is shown in FIGS. 3 and 4.

In forming the sleeve 14, as the blister card 12 is substantially fully inserted, the slanted upper surface of the detent 29 allows the blister card 12 to slide over the detent 29 and deflect the springs 48 until the detent 29 is received in the aperture 34. As the detent 29 is received in the aperture 34, the springs 48 force a portion of the blister card 12 against the top 18 and retain the detent 29 in the aperture 34. The blister card 12 is thereby secured in the outer sleeve 14 to form the package 10.

The blister card 12 can be extended or partially removed from the outer sleeve 14 by depressing the push button 20 and simultaneously pulling the blister card 12 from the opening of the outer sleeve 14. Depressing the push button 20 moves the blister card 12 toward the base 18 such that the detent 29 is disengaged from the aperture 34 and the springs 48 are deflected. Thereby, the blister card 12 can be extended from the outer sleeve without being obstructed by the detent 29. The blister card 12 can continue to be removed from the outer sleeve 14 until the aperture 34 is engaged by the retainer 54.

Figure 3:
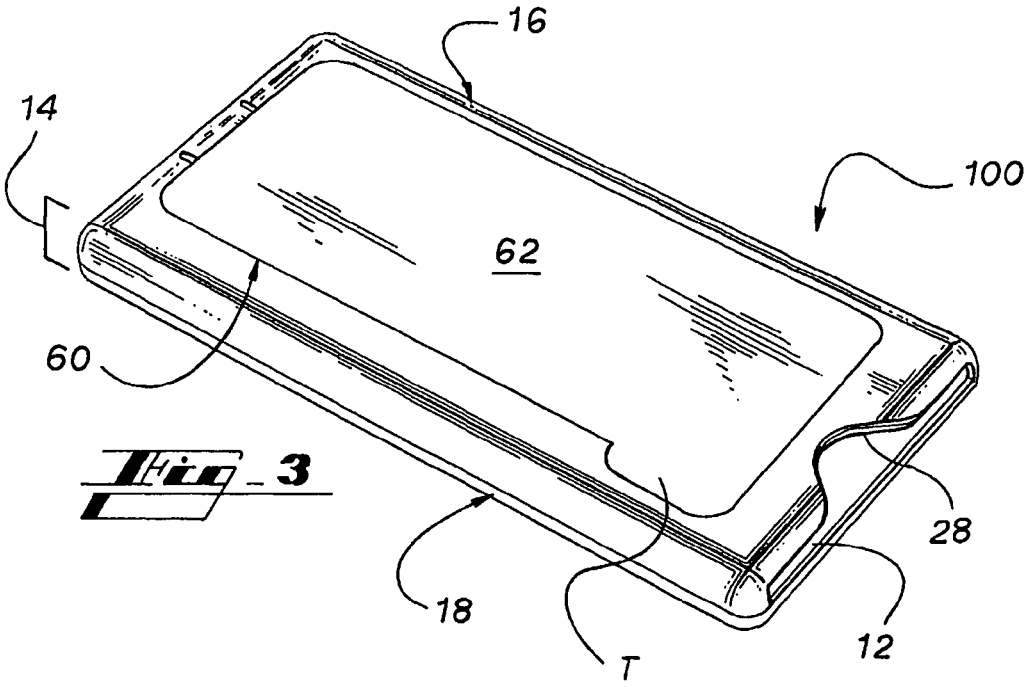
FIG. 3 is a perspective view of an exemplary embodiment of a child-resistant package with insert, according to the present invention.
Figure 4:
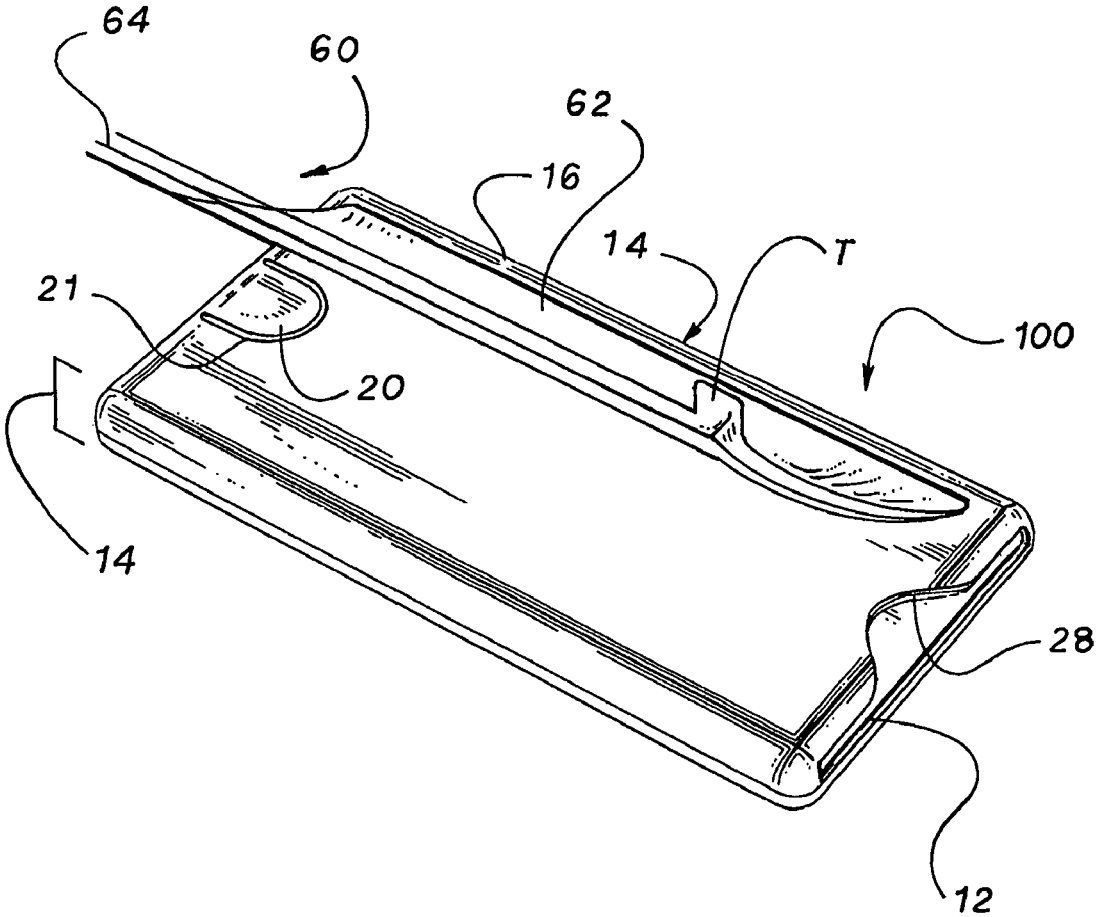
FIG. 4 is a perspective view of another exemplary embodiment of a child-resistant package with insert, according to the present invention.

FIG. 3 illustrates an exemplary embodiment of a child-resistant package 100 wherein a decoy cover 60 is attached to cover or otherwise obscure the push button 20, according to the present invention. The decoy cover 60 may be only one panel that serves as an outermost panel 62 that is releasably secured over the release mechanism. For example, the panel 62 may be in the form of a sticker attached by an adhesive. The material used to form the outer sleeve 14, the material used to form the decoy cover 60, and a type of adhesive can be chosen such that the decoy cover 60 can be repeatedly successively secured to, and detached from, the outer sleeve 14. In certain exemplary embodiments, the material used to form the decoy cover 60 is chosen to be substantially impenetrable such that a child cannot push through the decoy cover 60 to engage the release mechanism. In the exemplary embodiment, the decoy cover 60 is large enough to substantially cover the entire top surface of the outer sleeve 14. However, the decoy cover 60 can be any size that is suitable to cover the push button 20. In additional embodiments, a camouflage material is used to form the decoy cover 60. For example, a material that is substantially visually similar to the material used to form the outer wall 16 of the outer sleeve 14 to which the decoy cover 60 is attached can be used to camouflage the release mechanism of the outer sleeve 14.

The outermost cover panel 62 may include a tab T. The distal end of each cover flap can be releasably secured to the outer wall 16 by means of an adhesive such that the tab T can be releasably adhered to the outer cover 14. Thereby, the decoy cover 60 covers the push button 20. The tab T may initiate lifting of the outermost panel 62 to pull the decoy cover 60 from the surface of the outer sleeve 14 so the user can access the push button 20.

Referring now to FIG. 4, another exemplary embodiment of a child-resistant package 100 is shown wherein the decoy cover 60 includes at least one additional panel 64 sandwiched between the outermost panel 62 and the outer wall 16 of the sleeve 14. In this embodiment, a first edge of each cover flap 62, 64 is attached in hinge-like fashion to the outer wall 16. Multiple cover flaps can be used to provide product information, instructions, or other text or graphics to the user.

In additional exemplary embodiments, the decoy cover is formed from a substantially rigid material and the outer sleeve and decoy cover include mechanical elements that allow the decoy cover to be secured and released from the outer sleeve. For example, the decoy cover can be a door that is hingedly attached along one edge of the outer sleeve. The distal end of the door can be secured to another edge of the outer sleeve with a mechanical mechanism such as a latch, a catch, a snapping mechanism, Velcro®, a detent and aperture arrangement, and the like. In further exemplary embodiments, the decoy cover can be a door that slides in a slot.

To an extent, a portion of the effectiveness of the decoy cover relies on cognitive skill differences between young children and adults. Young children typically do not use the scientific method in solving problems. That is, they do not generate and test hypotheses related to the problems they face. In fact, the problem-solving behavior of young children exhibits a so-called win-shift pattern. In other words, a child will typically attempt incorrect solutions repeatedly and only shift to a correct solution after it is found by accident. Thus, additional child-resistance can be provided by hiding or disguising the correct solution such that it will not even be attempted.

In this way, the decoy cover makes it necessary for a child to go through an additional stage of accidental discovery to obtain access to the contents of the package. Thus, for example, if the decoy cover is used to disguise the release mechanism of a package, and that release mechanism requires dexterity, the child will have to first accidentally discover the release mechanism of the package and then, additionally, accidentally trigger the release mechanism to access the contents of the package. The package is then resistant to a greater number of children, including those who do not discover the release mechanism and those who do discover the release mechanism, but do not correctly trigger the release mechanism.

The scope of the invention is not limited to the exemplary embodiments of packages shown in FIGS. 1-4. Rather, the invention is applicable to any package with an outer sleeve that includes a release mechanism accessible from an outer wall for releasing a structure from the outer sleeve.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A sleeve comprising:

at least one outer wall;

a release mechanism including a shaped channel extending through the at least one outer wall and a deflectable push button integrally formed with the at least one outer wall, the deflectable push button being defined in the at least one outer wall by the shaped channel; and a decoy cover in the form of a sticker attached to the at least one outer wall to obscure the push button wherein the decoy cover comprises a portion thereof adapted to facilitate initiation of separating the decoy cover from the at least one outer wall;

wherein the decoy cover is attached to the at least one outer wall in a face contacting relationship by an adhesive that facilitates repeated successive removal and reattachment thereto, and wherein a first edge of the decoy cover is attached to the at least one outer wall in hinge-like fashion.

2. The sleeve of claim 1, further comprising a slide card slidably received in the sleeve and a locking detent extending inwardly from an inside surface of the at least one outer wall, the locking detent is lockably and releasably engageable with the slide card such that the slide card is at least partially removable from the sleeve upon actuation of the release mechanism.

3. The sleeve of claim 1, wherein the portion of the decoy cover is releasably adhered to the at least one outer wall.

4. The sleeve of claim 1, wherein the decoy cover comprises an outermost panel that is formed from a material that is substantially visually simulative to a material used to form the at least one outer wall.

5. The sleeve of claim 1, wherein the shaped channel is generally U-shaped.

6. The sleeve of claim 1, wherein the push button has a supported end and an opposed free end, the supported end being integrally connected to the at least one outer wall.

7. A sleeve comprising:

at least one outer wall comprising a release mechanism in the form of a pushbutton disposed therein; and a decoy cover in the form of a sticker disposed over the release mechanism, wherein the decoy cover comprises an outermost panel and at least one additional panel associated in separable face-contacting condition with the outermost panel, the decoy cover further comprising a portion thereof extending therefrom adapted to facilitate initiation of separating the decoy cover from the at least one outer wall;

wherein the decoy cover is attached to the at least one outer wall by an adhesive that facilitates repeated successive removal and reattachment thereto;

wherein a first edge of the decoy cover is attached to the at least one outer wall in hinge-like fashion.

8. The sleeve of claim 7, wherein the at least one additional panel is sandwiched between the outermost panel and the at least one outer wall.

9. A sleeve comprising:

at least one outer wall comprising a release mechanism in the form of a pushbutton disposed therein; and a decoy cover in the form of a sticker disposed over the release mechanism, wherein the decoy cover is attached to the at least one outer wall by an adhesive that facilitates repeated successive removal and reattachment thereto;

wherein a first edge of the decoy cover is attached to the at least one outer wall in hinge-like fashion;

wherein the decoy cover further comprises a portion thereof adapted to facilitate initiation of separating the decoy cover from the at least one outer wall.

10. The sleeve (14) of claim 9, the decoy cover (60) comprising an outermost panel (62) from which the portion (T) extends.

* * * * *